United States Patent [19]

Benda et al.

[11] 4,061,945

[45] Dec. 6, 1977

[54] SHIELDED GETTER SUPPORT ON ROTOR-SUPPORTED ANTENNA

[75] Inventors: David Benda, Geneva; Charles A. Davis, Auburn, both of N.Y.

[73] Assignee: GTE Sylvania Incorporated, Stamford, Conn.

[21] Appl. No.: 747,363

[22] Filed: Dec. 3, 1976

[51] Int. Cl.[2] ..... H01J 29/94; H01K 1/52

[52] U.S. Cl. ..... 313/481; 313/178

[58] Field of Search ..... 313/481, 178

[56] References Cited

U.S. PATENT DOCUMENTS

| | | | |
|---|---|---|---|
| 3,939,376 | 2/1976 | Reash | 313/481 |
| 3,961,221 | 6/1976 | Benda et al. | 313/481 |

*Primary Examiner*—Robert Segal

*Attorney, Agent, or Firm*—Norman J. O'Malley; Frederick H. Rinn; Robert T. Orner

[57] ABSTRACT

The invention provides an improvement in the means for supporting a container of effusive material located on the terminal end of an antenna-type positioning member for use in a cathode ray tube. The supporting structure is comprised of a rotatable member accommodated on axle means affixed to the positioning member at a region rearward from the forward edge of the material container. An augmentive fender-like protective component is associated with the rotatable member to shield that member from effusive material and to prevent any accumulated electric charge thereon from interfering with the scanning of the electron beam in the tube.

5 Claims, 5 Drawing Figures

SHIELDED GETTER SUPPORT ON ROTOR-SUPPORTED ANTENNA

BACKGROUND OF THE INVENTION

This invention relates to cathode ray tube effusive material structures and more particularly to an improvement in the insulative means for supporting a container of effusive material within a cathode ray tube.

In cathode ray tubes of the type conventionally employed in image display applications, at least one effusive material structure, as for example, a getter, is affixed to the forward end of the electron generating assembly oriented within the neck portion of the tube envelope. An exemplary type of getter structure is one referenced within the art as an antenna getter, which conventionally includes a resilient longitudinal positioning member or wand having a curvature therein and a getter container terminally mounted thereon. Such antenna type structures are usually affixed to the anterior portion of the electron gun assembly, extending forwardly therefrom in an outward curving manner prior to the positioning of the assembly within the restrictive neck portion of the tube envelope. The curved wand, being a resilient member, exhibits flexure to facilitate insertion of the electron gun assembly into the neck portion, while assuring sequential orientation of the forward extending getter container in a position closely adjacent to the interior surface of the outwardly flared infundibular portion of the tube envelope.

It is conventional practice in the art to coat the interior surface of the funnel portion of the tube envelope, and the forward area of the integral neck portion thereof, with one or more electrical conductive coatings. In certain tube constructions, it is desirable to isolate the finally positioned getter from the respective funnel-disposed coating therebeneath. Such discrete positioning is achieved by the getter supportive means taught in U.S. Pat. No. 3,961,221, which is assigned to the assignee of the present invention. This patent discloses a wand type cathode ray tube getter structure having a discrete support means in the form of a rotatable member oriented at the forward end thereof. The rotatable member being formed as a wheel of insulative material, beneficially effects facile positioning and positive spatial supportive placement of the container relative to the wall of the envelope, and thereby minimizes abrasion of the coating on the interior surface of the tube during positioning therein. Upon final positioning, the insulative wheel desirably isolates the getter from the adjacent coated surface of the funnel. However, in some tubes it has been found that the forward oriented rotatable member may be within the path of the scanning electron beam or beams. In such cases, any build-up of electric charge accumulative on the insulative member tends to introduce display pattern distortion during normal scan operation of the tube. Additionally, there have been occasions when spurious depositions of effusive material on the rotatable member have diminished the insulative characteristics of the member.

OBJECTS AND SUMMARY OF THE INVENTION

It is an object of the invention to reduce and obviate the aforementioned disadvantages of the prior art. Another object is to provide improved shielded means for supporting a container of effusive material in an insulative manner within a cathode ray tube to inhibit the deposition of effusive material thereon and to prevent any accumulated electric charge thereon from interfering in the operation of the tube.

These and other objects and advantages are achieved in one aspect of the invention as an improvement in shielding the rotatable means for supporting a container of effusive material affixed to the terminal end of an antenna-type positioning member for use in a cathode ray tube. The improved supporting structure is in the form of axle means, accommodating an insulative rotatable member thereon, attached to the positioning member in a manner normal thereto, at a region removed from the forward end of the getter structure to permit the rotatable member to be fully oriented at a location rearward of the forward edge of the container. Associated with the rotatable member is a protective component formed as a cooperating fender-like structure oriented in spaced adjacency to the rotatable member to shield the member from getter deposition and to prevent any accumulated electric charge thereon from interfering with the intended electron beam scan pattern in the tube.

DETAILED DESCRIPTION OF THE PREFERRED EMBODIMENT

For a better understanding of the present invention, together with other and further objects, advantages and capabilities thereof, reference is made to the following specification and appended claims in connection with the aforedescribed drawings.

The improved supportive structure of the invention, as described herein, is adaptable to supporting various types of containers of effusive materials, such as those supplying gettering gas-adsorbing substances, givers of selective gases or metallic depositions. Thus, the scope of the invention is intended to represent sufficient generic breadth to include the accommodation of any vaporizable or effusive material that may be desirably disposed within the tube envelope from the structure means disclosed. For purposes of example, the improved support means of the invention will be described as relating to a gettering structure.

Figure 1:
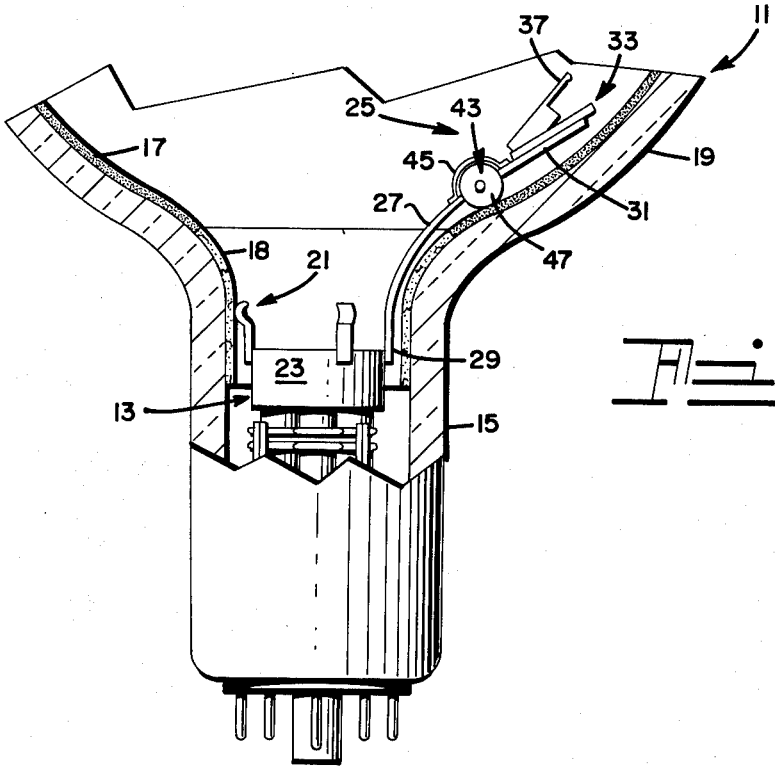
FIG. 1 is a partially sectioned view of a cathode ray tube illustrating the positioning of the invention therein.

In referring to the drawings, FIG. 1 illustrates a partially sectioned view of a cathode ray tube 11 wherein a multi-electrode electron gun assembly 13 is positioned within the neck portion 15 of the tube envelope in a manner to project at least one beam of electrons to selectively impinge a panel-disposed cathodoluminescent screen, not shown. In the exemplary tube, at least first and second selected coating materials 17 and 18 are areally disposed on the interior surface of the funnel portion 19 of the tube envelope. The second coating 18 extends integrally therefrom into the forward region of the adjoining neck portion 15 whereat electrical connection is made with several contacting or snubber means 21 oriented on the terminal electrode 23 of the electron gun assembly 13.

As shown, an antenna-type getter structure 25 is also affixed to the forward portion of the electron gun assembly 13. This getter structure per se, includes a longitudinal positioning member or wand 27 formed as a curved resilient member having a first end 29 attached to the electron gun and an opposed second end 31 whereat a container 33 of effusive gettering material 35 is affixed at the terminal region thereof.

Figure 2:
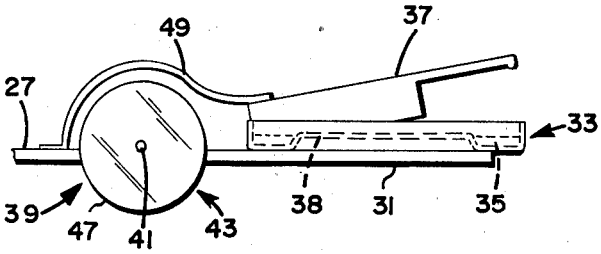
FIG. 2 is an enlarged sectional view detailing the improved shielded orientation of the rotatable member associated with the effusive structure.

As further illustrated in FIG. 2, the exemplary container 33 is, for example, of the annular channel type containing an effusive gettering material 35 therein and having directional shielding means 37 incorporated therewith in a manner to substantially direct the dispersion of the effused gettering material away from the container and substantially toward the forward region of the funnel portion 19. The container is formed to have bottom closure means 38 to prevent downward dispersion of the effused gettering material.

The improved and shielded getter supportive means 39, as detailed in the drawings, comprises an axle means 41, having a wheel-like member 43 rotatably accommodated thereon, which is attached to the longitudinal positioning member 27 in a substantially transverse manner substantially normal thereto at a region removed rearward from the forward or second end 31. Such positioning permits the rotatable member to be fully oriented at a location rearward of the forward edge of the getter container 33. Associated with the rotatable member is a cooperating fender-like structure, such as 45, which is oriented in spaced adjacency to the rotatable member 43, such being discretely formed and positioned in a manner to inhibit the deposition of getter material on the rotatable member. Additionally, the shielded positioning of the member prevents any accumulated electric charge thereon from interfering with the scanning of the electron beam.

Figure 3:
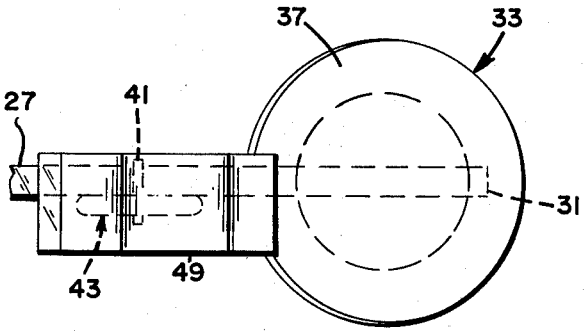
FIG. 3 is a plan view of the structure shown in FIG. 2.

Conventionally, the rotatable member is delineated substantially as a wheel-like component, having a peripheral contacting surface 47 which tracks on the interior surface of the tube or coatings disposed thereon, in a direction common with the directional trend of the positioning member 27. The contact or peripheral tracking surface 47 of the rotatable member is of a rounded contour to minimize areal contact with the surface coatings on the neck 15 and funnel 19 portions of the tube envelope. The wheel-like component, being oriented rearward of the forward or second end 31 of the positioning member 27, provides limited tracking contact within the funnel portion 19. Usually, the rotatable member is formed of an insulative composition, such as glass or ceramic. As shown in FIGS. 1, 2, and 3, this insulative wheel-like component, electrically isolating the getter from the funnel coating therebeneath, is oriented by the axle means 41 located on the positioning member immediately rearward of the getter container 33. In each instance, the fender-like shield means, associated with the wheel-like component, is a substantially arcuate shaped areal member having a breadth greater than the width of the rotatable member. In FIG. 1, the shield means 45 is fully oriented on the positioning member 27, while in FIGS. 2 and 3, the shield means 49 is an integral extension of the container shield 37.

Figure 4:
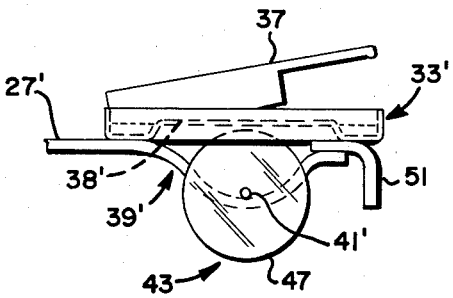
FIG. 4 is an enlarged sectional view detailing another shielded location of the rotatable member.
Figure 5:
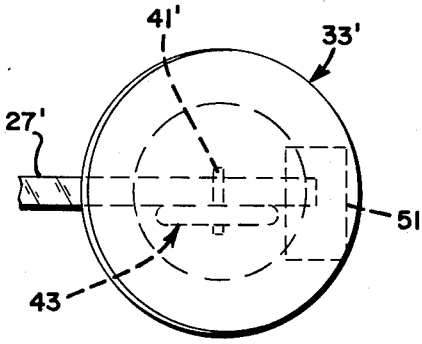
FIG. 5 is a plan view of the embodiment illustrated in FIG. 4.

The embodiment of the invention as illustrated in FIGS. 4 and 5, denotes a similar material-effusive structure wherein the container is an annular or ring-type member 33' having a bottom closure member 38' formed in a concave manner. In this instance, the axle means 41', supporting the rotatable member 43, is transversely oriented normal to the positioning member 27' in a substantially diametrical relationship to the circular concavity, to effect positioning of a peripheral portion of the rotatable member 43 spatially within the shielding concavity 38'. In this embodiment the discretely formed shielding means 51 is likewise directly associated with the rotatable member 43, such being positioned forward thereof inhibits deposition of getter material on the wheel-like member and prohibits any electric charge buildup on the member from influencing the scan of the beam.

Thus, there is provided an improvement in the rotatable means for supporting a container of effusive material which is affixed to the terminal portion of an antenna-type positioning member for use in a cathode ray tube. The invention utilizes a discretely shielded rotatable member oriented in a protective manner relative to the getter container to inhibit deposition of effusive material on the rotatable supporting member, and additionally to prevent the presence of any buildup of electric charge on the wheel-like component from causing display pattern distortion during normal scan operation of the tube.

While there has been shown and described what are at present considered the preferred embodiments of the invention, it will be obvious to those skilled in the art that various changes and modifications may be made therein without departing from the scope of the invention as defined by the appended claims.

What is claimed is:

1. In a cathode ray tube having an envelope formed of an integration of neck, funnel and panel portions wherein an electron gun assembly is positioned within the neck portion in a manner to beam electrons to impinge a cathodoluminescent screen disposed on the panel portion thereof, improved means for supporting a container of effusive material within substantially the funnel portion of the envelope comprising:

an antenna-type longitudinal positioning member having first and second ends, said first end being attached to said electron gun assembly with the second end thereof having said container located thereat;

rod-like axle means attached to said longitudinal positioning member in a substantially transverse manner and substantially normal thereto at a region removed rearward from said second end thereof;

a rotatable member positioned in a freely turning manner on said axle means, said axle and rotatable member being fully oriented at a location rearward of the forward edge of said container; and protective means associated with said rotatable member and formed as a fender-like shielding component to inhibit the deposition of effusive material on said rotatable member and to prevent any accumulated electric charge on said member from deleteriously influencing the scan pattern of the tube.

2. Improvement in the support means for accommodating a container of effusive material according to claim 1 wherein said rotatable means is oriented by said axle means on said positioning member immediately rearward of said container.

3. The improvement in the support means for accommodating a container of effusive material according to claim 2 wherein said fender-like shielding component is an arcuate shaped areal member having a breadth greater than the width of said rotatable member.

4. The improvement in the support means for accommodating a container of effusive material according to claim 2 wherein said fender-like shielding component is an integral areal extension of said container shield.

5. The improvement in the support means for accommodating a container of effusive material according to claim 1 wherein said container is a ring-type structure having a concave bottom closure member, said axle means being oriented substantially in diametrical relationship thereto in a manner to position a peripheral portion of said rotatable member spatially within said concavity.

* * * * *